US010018018B2

(12) United States Patent
Cannon et al.

(10) Patent No.: US 10,018,018 B2
(45) Date of Patent: Jul. 10, 2018

(54) SYSTEM AND METHOD FOR PROVIDING A RESILIENT SOLID FUEL SOURCE IN A WELLBORE

(71) Applicants: Edwin A. Cannon, Waller, TX (US); John D. Loehr, Fulshear, TX (US); Kent S. Meyer, Tomball, TX (US)

(72) Inventors: Edwin A. Cannon, Waller, TX (US); John D. Loehr, Fulshear, TX (US); Kent S. Meyer, Tomball, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 265 days.

(21) Appl. No.: 14/276,482

(22) Filed: May 13, 2014

(65) Prior Publication Data

US 2015/0330171 A1 Nov. 19, 2015

(51) Int. Cl.
*E21B 41/00* (2006.01)
*E21B 23/04* (2006.01)

(52) U.S. Cl.
CPC ..... *E21B 41/00* (2013.01); *E21B 23/04* (2013.01)

(58) Field of Classification Search
CPC ..... E21B 23/065
See application file for complete search history.

(56) References Cited

U.S. PATENT DOCUMENTS 3,031,347 A 4/1962 Philipson
3,112,233 A * 11/1963 Friedman ..... C09K 8/16 149/10
3,136,122 A 6/1964 McJones
3,257,248 A * 6/1966 Short ..... C06B 45/10 149/19.6
3,270,668 A * 9/1966 Silver ..... E21B 36/02 102/313
3,713,393 A * 1/1973 O'Connor ..... E21B 43/1185 102/202
3,804,683 A 4/1974 Baldwin et al.
4,072,546 A * 2/1978 Winer ..... C06B 45/00 102/289
5,396,951 A 3/1995 Ross
7,228,906 B2 6/2007 Snider et al.
7,237,616 B2 7/2007 Patel
8,839,871 B2 * 9/2014 Wright ..... E21B 23/04 166/165
2005/0022987 A1 2/2005 Green et al.
2013/0032337 A1 * 2/2013 Rytlewski ..... F42B 3/117 166/250.1
2013/0312954 A1 11/2013 Di Crescenzo et al.

OTHER PUBLICATIONS

Dictionary definitions of "resilient", "dispersed", accessed on May 20, 2016 via www.thefreedictionary.com.*

(Continued)

*Primary Examiner* — David J Bagnell
*Assistant Examiner* — Manuel C Portocarrero
(74) *Attorney, Agent, or Firm* — Cantor Colburn LLP

(57) ABSTRACT

A system, method and apparatus for providing a fuel source in a wellbore is disclosed. A tool is placed into a wellbore. A primary charge is associated with the tool. A secondary charge associated with the tool is provided. The secondary charge includes a resilient solid propellant.

19 Claims, 6 Drawing Sheets

(56) References Cited

OTHER PUBLICATIONS

Definition of "Young's Modulus", accessed on May 20, 2016 via http://www.britannica.com/science/Youngs-modulus.*
Accessed definition of Young's modulus on Nov. 27, 2016 via Encyclopedia Britannica https://www.britannica.com/science/Youngs-modulus.*
Accessed definition of resilient on Nov. 27, 2016 via http://www.thefreedictionary.com/resilient.*
IPRP/WO, dated Nov. 24, 2016.
ISR, dated Jul. 22, 2015.

* cited by examiner

SYSTEM AND METHOD FOR PROVIDING A RESILIENT SOLID FUEL SOURCE IN A WELLBORE

BACKGROUND

1. Field of the Disclosure

The present invention is related to a system, apparatus and method of providing a fuel source in a wellbore and, in particular, a system, apparatus and method of providing a solid resilient fuel source for equipment used in a wellbore.

2. Background of the Art

Various downhole operations, such as production, fracturing operations, etc., require downhole fuel sources. In such applications, packers and other setting tools, which may be actuated and expanded by combustion of fuel sources, may be used. In order to actuate these tools, a multistage charge utilizing pressed powder fuel sources may be used. However, most current pressed powder fuel sources may not adequately cope with severe vibrations and stress that occur in horizontal and vertical wellbores. Current fuel source technologies may consequentially experience fractures or separations, often leading to insufficient performance or lack of combustion, preventing desired operation of the designated tool.

SUMMARY OF THE DISCLOSURE

In one aspect, the present disclosure provides a system for use in a wellbore, the system including: a tool; a primary charge; and a secondary charge associated with the primary charge and the tool, wherein the secondary charge includes a resilient solid propellant.

In another aspect, the present disclosure provides an apparatus for use in a wellbore, the apparatus including: a primary charge; and a secondary charge including a flammable metal and a resilient solid propellant.

In yet another aspect, the present disclosure provides a method for use in a wellbore, the method including: placing a tool in the wellbore; providing a primary charge associated with the tool; providing a secondary charge associated with the tool; wherein the secondary charge includes a resilient solid propellant.

Examples of certain features of the apparatus and method disclosed herein are summarized rather broadly in order that the detailed description thereof that follows may be better understood. There are, of course, additional features of the apparatus and method disclosed hereinafter that will form the subject of the claims appended hereto.

BRIEF DESCRIPTION OF THE DRAWINGS

The disclosure herein is best understood with reference to the accompanying figures in which like numerals have generally been assigned to like elements and in which.

DESCRIPTION OF THE EMBODIMENTS

Figure 1:
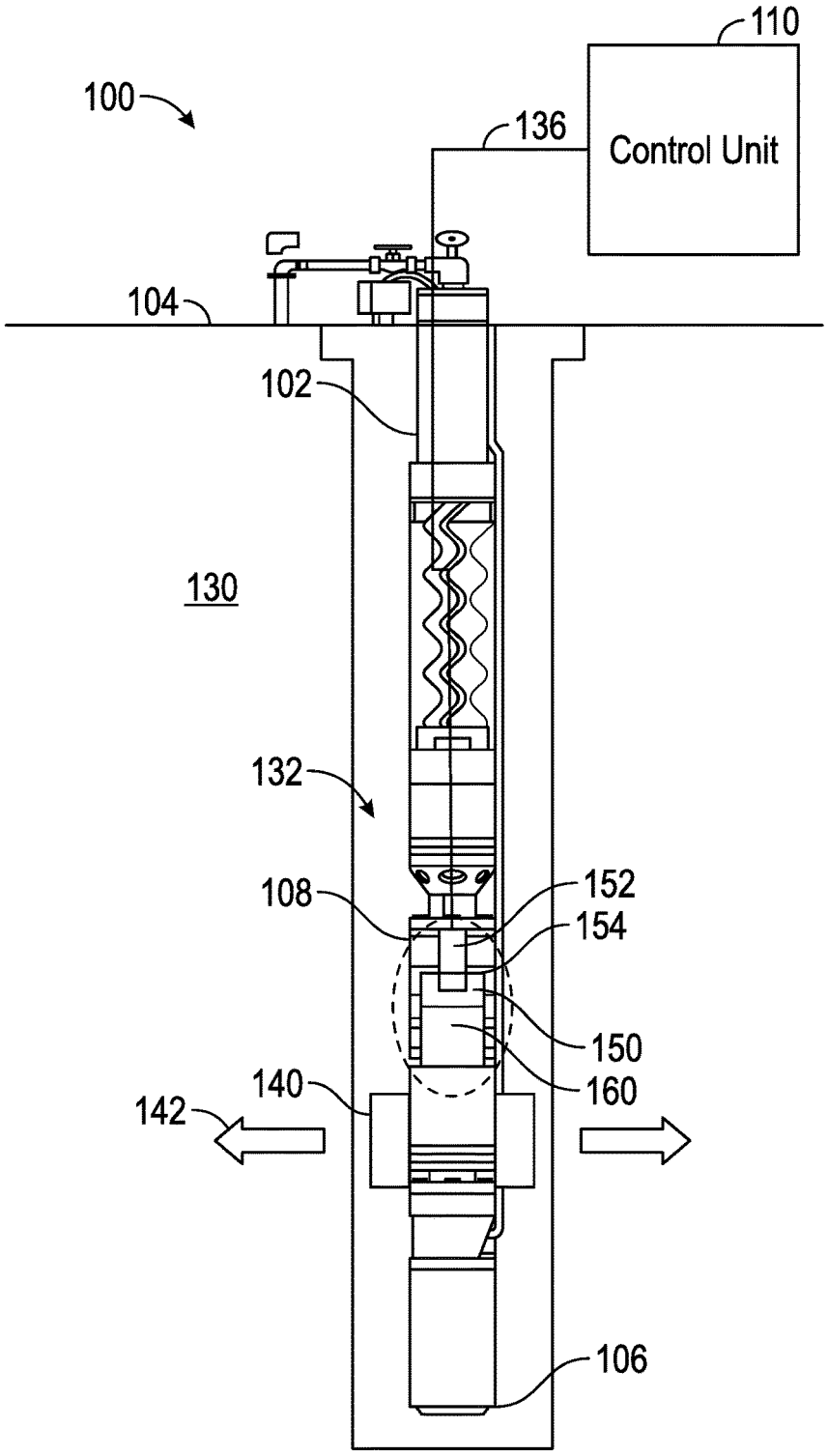
FIG. 1 shows a downhole system that includes a tool utilizing a resilient solid fuel source in an exemplary embodiment of the disclosure.

FIG. 1 shows a downhole system 100 that includes an expanding tool for setting, packing, or other operations of the downhole system 100 in an exemplary embodiment of the disclosure. The downhole system 100 includes a work string 102 disposed in a wellbore 132 formed in a formation 130. The work string 102 extends in the wellbore 132 from a surface location 104 to a downhole location 106. The work string 102 may include a drill string, a production string, a fracturing system including a multi-stage fracturing system, a perforation string, etc. A tool 108 for performing a downhole operation is conveyed to a selected depth of the wellbore by the work string 102. The tool 108 may be a setting tool, a packing tool or other tool that relies on a downhole fuel source for expansion or general operation, for example. The tool 108 may be coupled to a control unit 110 via cable 136. Control unit 110 controls the tool 108 to actuate the tool via igniting the fuel source, controlling combustion of a fuel source within the tool, and other functions of the tool. In various embodiments, the control unit 110 may be at a surface location 104 or at a suitable location in the work string 102. The control unit 110 may perform the methods disclosed herein for controlling operation of the tool 108 using the fuel source 150.

The tool 108 is schematically illustrated in FIG. 1. As previously discussed, the tool 108 may be any tool that expands, sets, separates, or is otherwise actuated by the expansion of combustible gases, such as those provided by the ignition of the fuel source 150. In an exemplary embodiment, the tool 108 is a tool wherein expanding elements 140 move outwardly in an expansion direction 142 when energized by high pressure gasses created by fuel source 150. Tool 108 may be used to prevent flow beyond the position of tool 108, secure another element of string 102 at a certain position at the wellbore 132, chemically cut an element of string 102, etc. In an exemplary embodiment, the fuel source 150 may be ignited to create high temperature and high pressure combustion gasses. In response to these gases, expanding elements 140 of tool 108 may move outwardly in an expansion direction 142 to secure expanding elements 140 towards the outer extents of wellbore 132. In certain embodiments, expanding elements 140 may be compliant elements, while in other embodiments, expanding elements 140 may be rigid elements. Further, expanding elements 140 may be slips or other elements that may expand to create contact with wellbore 132.

Fuel source 150 may be used to actuate tool 108. In exemplary embodiments, fuel source 150 may be a multi-stage charge, including a communication wire 136, a primary charge 152, a secondary charge 154, and a power charge 160. Details of the fuel source are discussed below with respect to FIGS. 2-10.

Figure 2:
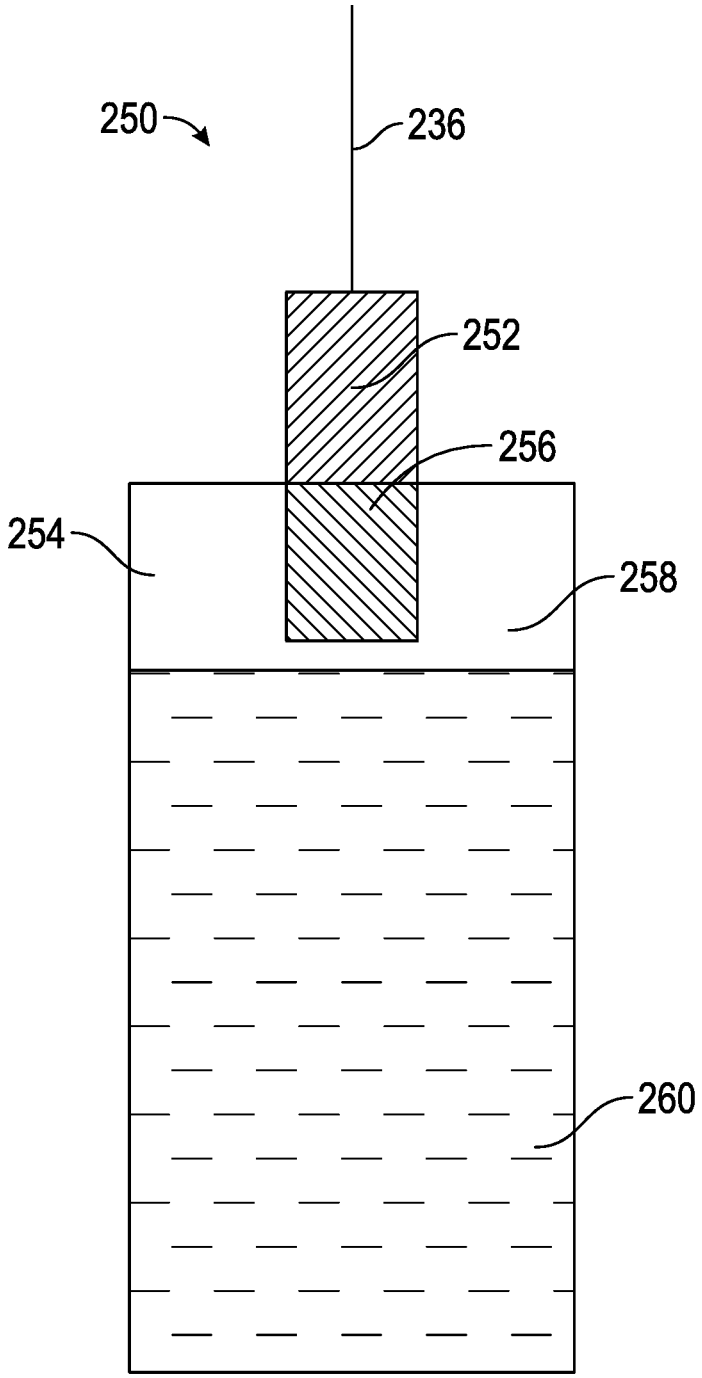
FIG. 2 shows an exemplary fuel source of the downhole system of FIG. 1 suitable for use in downhole operations in an exemplary embodiment of the present disclosure.

FIG. 2 shows an exemplary fuel source 250 suitable for use in downhole operations in an exemplary embodiment of the present disclosure. Fuel source 250 may be used in any mechanical, flammable, or explosive downhole device. The fuel source 250 includes a primary charge 252, a secondary charge 254, and a power charge 260. The primary charge 252 includes an explosive that is extremely sensitive to stimuli, requiring a small amount of energy to initiate combustion. In at least one embodiment, a control unit (FIG. 1, 110) may send a signal via wire 236 to stimulate primary charge 252 to combust. In other embodiments wire 236 can be similar to or correspond to any suitable wire, including wire 136, 336, 436, 536, 636, 736, 836, 936, and 1036. The combustion of primary charge 252 may initiate the combustion of secondary charge 254. In an exemplary embodiment, the secondary charge 254 includes a secondary igniter 256 and a solid propellant 258. In certain embodiments, the elements of secondary charge 254 may require higher activation energy than that required of primary charge 252. Secondary igniter 256 may be disposed to be embedded within solid propellant 258. In certain embodiments, secondary igniter 256 may be formed to be integral to solid propellant 258. Secondary igniter 256 may be made of any flammable metal to initiate ignition of the solid propellant 258. In an exemplary embodiment, secondary igniter 256 may be a boron pellet.

After the secondary igniter 256 is ignited by the primary charge 252, the secondary igniter 256 may ignite the solid propellant 258 portion of the secondary charge 254. In an exemplary embodiment, the solid propellant 258 portion of the secondary charge 254 may be associated with the power charge 260 to allow ignition of the power charge 260. The solid propellant 258 allows for increased reliability and complete burning of fuel compared to blended and pressed compositions, which may break under stress or impact. In an exemplary embodiment, the solid propellant 258 includes a plasticized composition. The plasticized composition of the solid propellant 258 allows for a more resilient fuel that is reliable in horizontal and vertical wellbore applications compared to pressed powder compositions. Further, the solid propellant 258 may allow for a more reliable and complete burn, as the solid propellant 258 includes an oxidizer to maintain combustion without an external oxidization source. Further, the properties of solid propellant 258 ensure the resulting combustion may not easily be extinguished.

The use of solid propellant 258 in conjunction with secondary igniter 256 allows for a secondary charge 254 to easily ignite to initiate combustion and then reliably combust to activate power charge 260. Power charge 260 is a relatively slow burning combustion fuel that provides the combustion gases for any mechanical, flammable or explosive type devices that may be used in a wellbore 132, with fuel source 250. Conventionally, the power charge 260 provides the majority of the combustion gasses to actuate the tool, such as expanding elements of a setting tool, or cutting elements.

Figure 3:
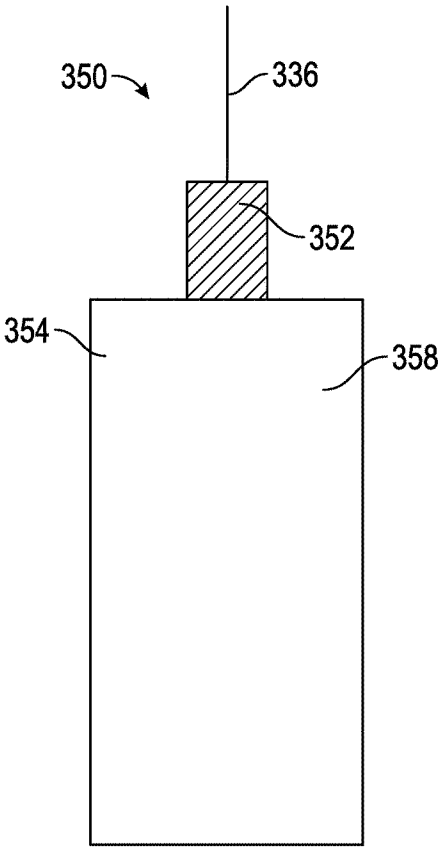
FIG. 3 shows another embodiment of a fuel source of the downhole system suitable for use in downhole operations in another embodiment of the present disclosure.

FIG. 3 shows an alternative fuel source 350 suitable for use in downhole operations in an alternative exemplary embodiment of the present disclosure. Fuel source 350 may be used in any mechanical, flammable, or explosive downhole device. The fuel source 350 includes a primary charge 352 and a secondary charge 354 that serves as both a secondary charge and power charge. Fuel source 350 receives a signal from wire 336 to stimulate primary charge 352. Primary charge 352 is ignited and combusts. The combustion of primary charge 352 begins the combustion of secondary charge 354. In this embodiment, secondary charge 354 includes solid propellant 358. Solid propellant 358 may have sufficient activation energy to reliably and completely burn solid propellant 358 without the use of a secondary igniter. Further, solid propellant 358 may be suitable to provide sufficient combustion gases for the operation of a tool 108 without the need for a power charge. Advantageously, the use of solid propellant 358 as both the secondary charge 354 and a power charge allows for simplicity, reliability in combustion, and resiliency due to the plasticized composition of the solid propellant 358.

Figure 4:
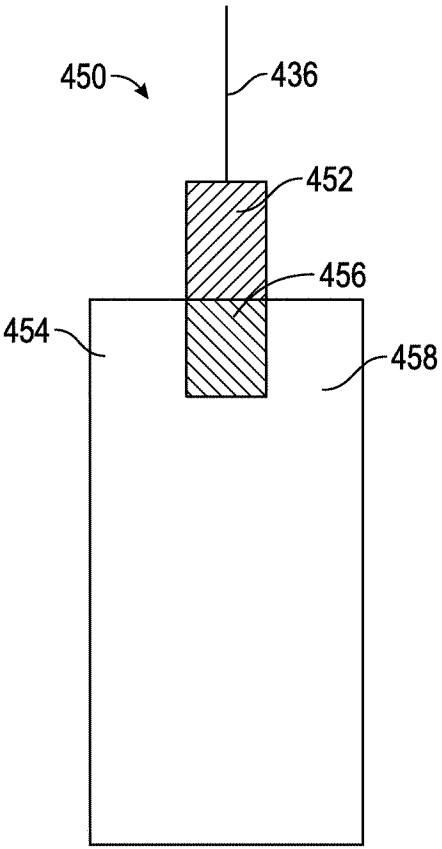
FIG. 4 shows another embodiment of a fuel source of the downhole system suitable for use in downhole operations in another embodiment of the present disclosure.

FIG. 4 shows an alternative fuel source 450 suitable for use in downhole operations in an alternative exemplary embodiment of the present disclosure. Fuel source 450 may be used in any mechanical, flammable, or explosive downhole device. Similar to fuel source 350, the fuel source 450 includes a primary charge 452 and a secondary charge 454 that serves as both a secondary charge and power charge. In this embodiment, the secondary charge 454 includes a secondary igniter 456 and solid propellant 458. In this embodiment, secondary igniter 456 is used to provide sufficient activation energy to the solid propellant 458 to ensure ignition and combustion of solid propellant 458.

Figure 5:
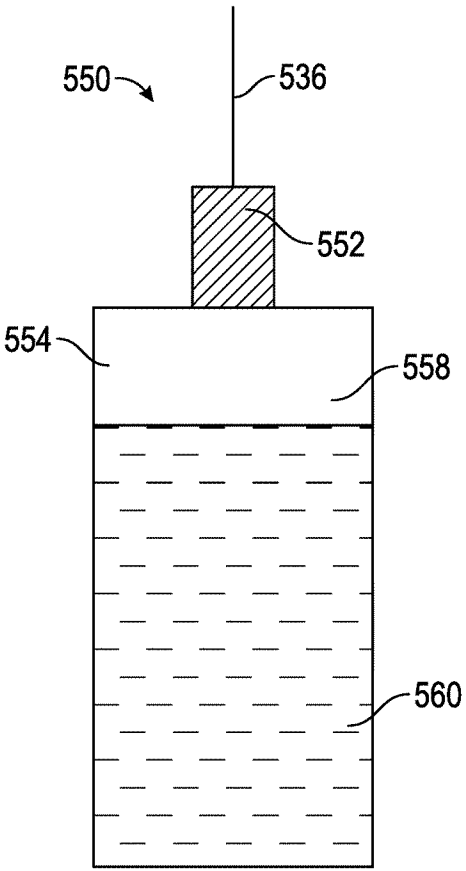
FIG. 5 shows another embodiment of a fuel source of the downhole system suitable for use in downhole operations in another embodiment of the present disclosure.

FIG. 5 shows an alternative fuel source 550 suitable for use in downhole operations in an alternative exemplary embodiment of the present disclosure. Fuel source 550 may be used in any mechanical, flammable, or explosive downhole device. Similar to fuel source 250, the fuel source 550 includes a primary charge 552, secondary charge 554, and a power charge 560. In this embodiment, the secondary charge 554 includes only a solid propellant 558 without a secondary igniter. In this embodiment, primary charge 552 is used to provide sufficient activation energy to the solid propellant 558.

Figure 6:
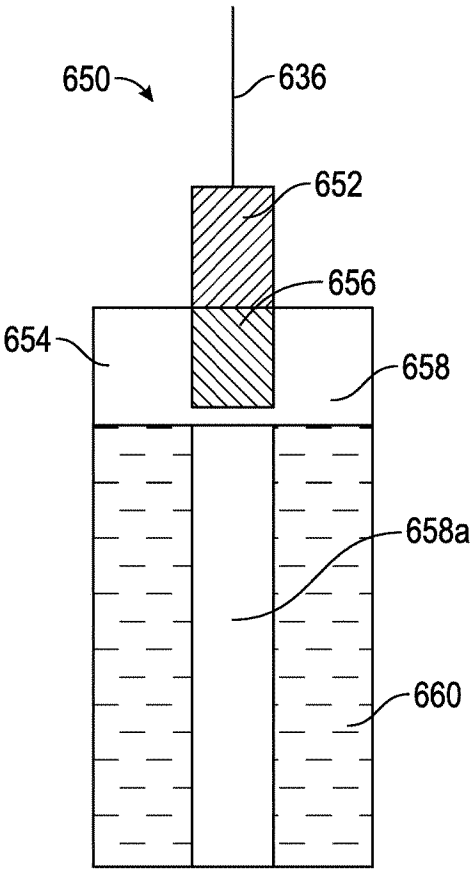
FIG. 6 shows another embodiment of a fuel source of the downhole system suitable for use in downhole operations in another embodiment of the present disclosure.

FIG. 6 shows an alternative fuel source 650 suitable for use in downhole operations in an alternative exemplary embodiment of the present disclosure. A secondary igniter 656 is provided. Fuel source 650 may be used in any mechanical, flammable, or explosive downhole device. Similar to fuel source 250, the fuel source 650 includes a primary charge 652 and a secondary charge 654, and a power charge 660. In this embodiment, the secondary charge 654 includes a solid propellant 658 that extends downwardly into the power charge 660. The extension of solid propellant **658*a* may be more easily formed due to the plasticized nature of the solid propellant. The extension of solid propellant 658*a* may be any shape. In an exemplary embodiment, the extension of solid propellant 658 may be a cylindrical extension downward into the power charge 660. The extension of the solid propellant 658 into power charge 660 may allow for more reliable operation and more complete combustion of power charge 660, as the combustion reaction from the secondary charge 654 may more readily access a larger surface area of power charge 660 and allow for greater combustion propagation from secondary charge 654**.

Figure 7:
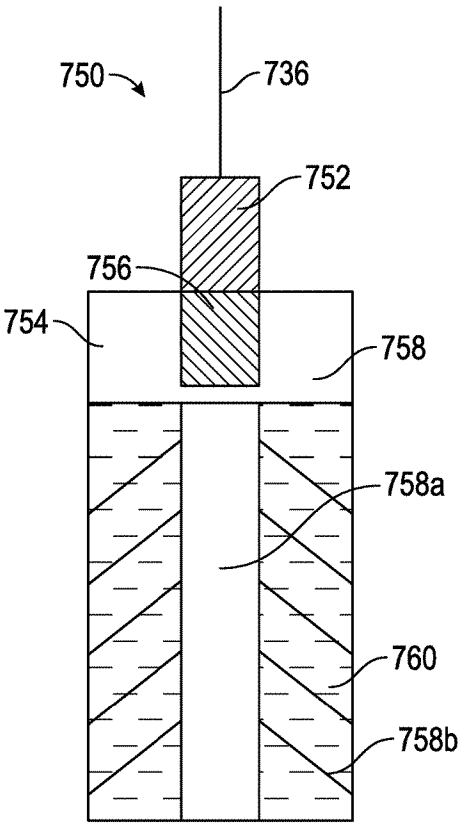
FIG. 7 shows another embodiment of a fuel source of the downhole system suitable for use in downhole operations in another embodiment of the present disclosure.

FIG. 7 shows an alternative fuel source 750 suitable for use in downhole operations in an alternative exemplary embodiment of the present disclosure. A secondary igniter 756 is provided. Fuel source 750 may be used in any mechanical, flammable, or explosive downhole device.

Similar to fuel source 650, the fuel source 750 includes a primary charge 752, secondary charge 754, and a power charge 760. In this embodiment, the secondary charge 754 includes a solid propellant 758 that extends downwardly into the power charge 760. Further, the solid propellant 758 may extend downward into the power charge 760 with a trunk 758*a* and branch 758*b* formation. The branches 758*b* may form any angle relative to the trunk portion 758*a* of the solid propellant extending into the power charge 760. In an exemplary embodiment, the branches 758*b* may extend outwardly at a 30 to 90degree angle relative to the central trunk portion 758*a*. The use of a trunk and branch formation of solid propellant 758 within the power charge 760 may allow for more reliable combustion propagation and a more complete combustion of the power charge 760.

Figure 8:
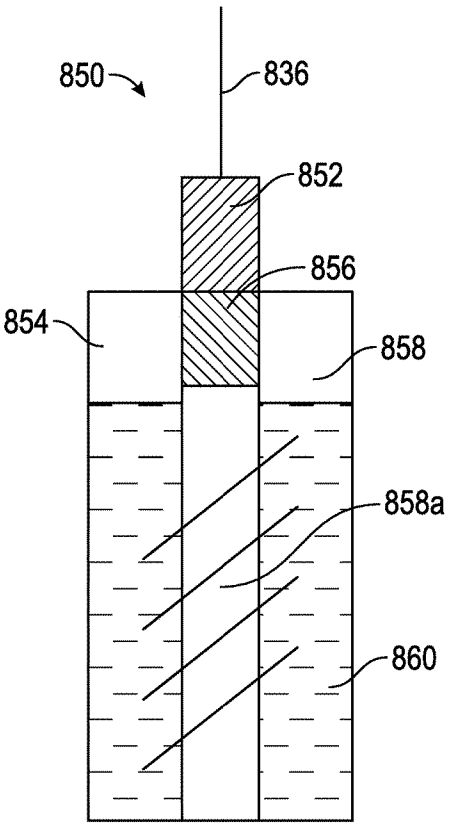
FIG. 8 shows another embodiment of a fuel source of the downhole system suitable for use in downhole operations in another embodiment of the present disclosure.

FIG. 8 shows an alternative fuel source 850 suitable for use in downhole operations in an alternative exemplary embodiment of the present disclosure. A secondary igniter 856 is provided. Fuel source 850 may be used in any mechanical, flammable, or explosive downhole device. Similar to fuel source 650, the fuel source 850 includes a primary charge 852, a secondary charge 854, and a power charge 860. In this embodiment, the secondary charge 854 includes an extension of solid propellant 858*a* that extends downwardly into the power charge 860. Further, to facilitate assembly of fuel source 850, the solid propellant 858 may have a screw thread like shape to be driven downward into the power charge 860. The use of a screw formation of solid propellant 858*a* within the power charge 860 may allow for more reliable combustion propagation and a more complete combustion of the power charge 860 while allowing for easier formation or assembly.

Figure 9:
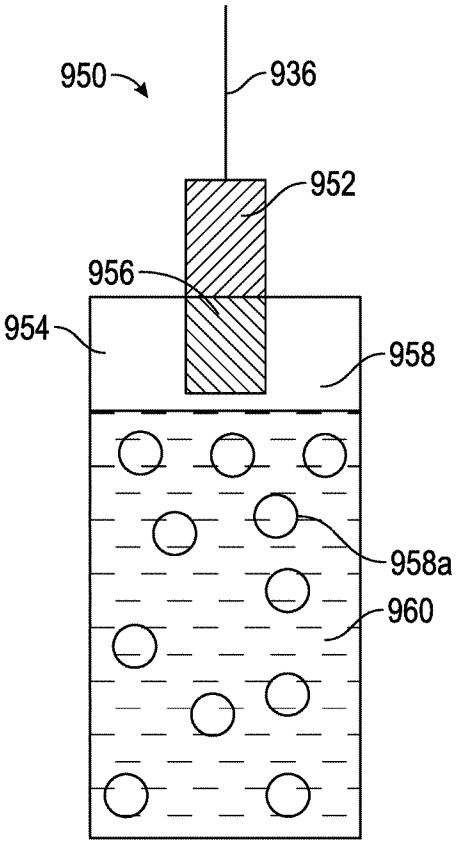
FIG. 9 shows another embodiment of a fuel source of the downhole system suitable for use in downhole operations in another embodiment of the present disclosure.

FIG. 9 shows an alternative fuel source 950 suitable for use in downhole operations in an alternative exemplary embodiment of the present disclosure. A solid propellant 958 is provided. Fuel source 950 may be used in any mechanical, flammable, or explosive downhole device. Similar to fuel source 550, the fuel source 950 includes a primary charge 952, secondary charge 954, and a power charge 960. In this embodiment, the power charge 960 includes a solid propellant 958*a* that is dispersed throughout the power charge 960. A secondary igniter 956 is provided. The dispersed particles of solid propellant 958*a* may be of any size. In an exemplary embodiment, the solid propellant 958*a* may have a size between 5 to 10 microns. The solid propellant 958*a* may be between 5% to 95% of the total power charge 960 by weight. In an exemplary embodiment, the power charge 960 has 30% to 40% solid propellant 958*a* by weight. Advantageously, the dispersed solid propellant 958*a* may allow for enhanced combustion, more reliable combustion and operation, and desired combustion characteristics. For example, the addition of dispersed solid propellant 958*a* may prevent the cessation of combustion due to a void, lack of oxidizer, or other cause of cessation.

Figure 10:
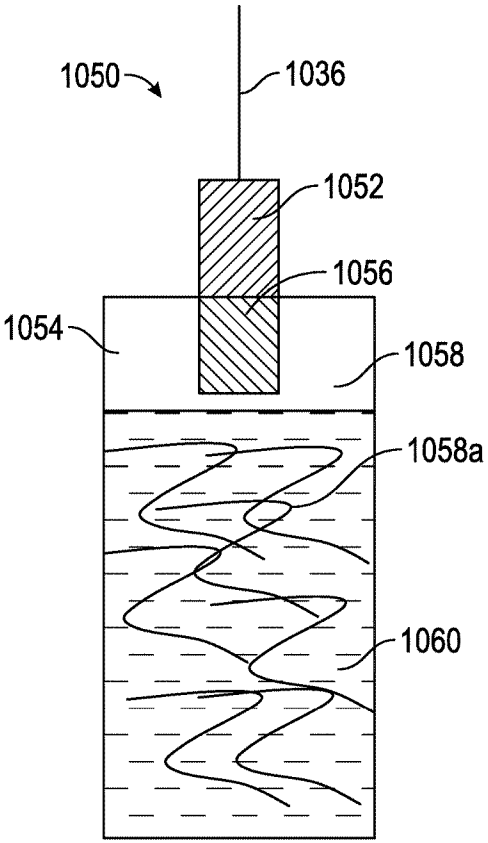
FIG. 10 shows another embodiment of a fuel source of the downhole system suitable for use in downhole operations in another embodiment of the present disclosure.

FIG. 10 shows an alternative fuel source 1050 suitable for use in downhole operations in an alternative exemplary embodiment of the present disclosure. A solid propellant 1058 is provided. Fuel source 1050 may be used in any mechanical, flammable, or explosive downhole device. Similar to fuel source 950, the fuel source 1050 includes a primary charge 1052, secondary charge 1054, and a power charge 1060. In this embodiment, the power charge 1060 includes solid propellant fibers 1058*a*that is dispersed throughout the power charge 1060. The dispersed particles of solid propellant 1058*a* may be fibers. In an exemplary embodiment, the solid propellant 1058*a* may have a size between 5 to 10 microns in size. The solid propellant 1058*a* may be between 5% to 95% of the power charge 1060 by weight. In an exemplary embodiment, the power charge 1060 has 30% to 40% solid propellant 1058*a* by weight. In an exemplary embodiment, the solid propellant 1058*a*may form a redundant, percolating network to allow combustion propagation evenly through the power charge 1060, allowing for reliable combustion of power charge 1060 even if portions of power charge 1060 experience incomplete combustion.

Therefore in one aspect, the present disclosure provides a system for use in a wellbore, the system including a tool; a primary charge; and a secondary charge associated with the primary charge and the tool, wherein the secondary charge includes a resilient solid propellant. In various embodiments, the secondary charge may include a flammable metal. In other embodiments, the system may include a power charge associated with the secondary charge. In various embodiments, the power charge may be between 5% to 95% of the solid propellant by weight. In certain embodiments, the secondary charge may be disposed within the power charge. In other embodiments, the secondary charge may extend radially through the power charge from a central position. In various embodiments the solid propellant of the power charge may be dispersed within the power charge. In various embodiments, the solid propellant of the power charge may be dispersed as fibers within the power charge.

In another aspect, the present disclosure provides an apparatus for use in a wellbore, including a primary charge; and a secondary charge including a flammable metal and a resilient solid propellant. In various embodiments, the apparatus further includes a power charge associated with the secondary charge. In various embodiments, the power charge may be between 5% to 95% of the solid propellant by weight. In certain embodiments, the secondary charge may be disposed within the power charge. In other embodiments, the solid propellant of the power charge may be dispersed within the power charge.

In yet another aspect, the present disclosure provides a method for use in a wellbore, including: placing a tool in the wellbore; providing a primary charge associated with the tool; providing a secondary charge associated with the tool; wherein the secondary charge comprises a resilient solid propellant. In various embodiments the method further includes providing a flammable metal coupled to the secondary charge. In various embodiments, the power charge may be associated with the secondary charge. The power charge may be between 5% to 95% of the solid propellant by weight. In various embodiments, the method may further include disposing the secondary charge within the power charge. The solid propellant of the power charge may be dispersed within the power charge. Further, the solid propellant of the power charge may be dispersed as fibers within the power charge.

While the foregoing disclosure is directed to the certain exemplary embodiments of the disclosure, various modifications will be apparent to those skilled in the art. It is intended that all variations within the scope and spirit of the appended claims be embraced by the foregoing disclosure.

What is claimed is:

1. A system for use in a wellbore, comprising:

a tool;

a primary charge with a first activation energy; and a secondary charge associated with the primary charge, wherein the secondary charge includes a plasticized solid propellant having a second activation energy greater than the first activation energy and an igniter that is a pellet embedded in the plasticized solid propellant, wherein combustion of the primary charge initiates combustion of the igniter which initiates combustion of the secondary charge.

2. The system of claim 1, wherein the secondary charge further includes a flammable metal.

3. The system of claim 1, further comprising a power charge associated with the secondary charge.

4. The system of claim 3, wherein the power charge includes a dispersed resilient plasticized solid propellant within the power charge, wherein the dispersed resilient plasticized solid propellant is between 5% to 95% of the power charge by weight.

5. The system of claim 4, wherein the dispersed resilient plasticized solid propellant of the power charge is dispersed as fibers within the power charge.

6. The system of claim 3, wherein the secondary charge is disposed within the power charge.

7. The system of claim 6, wherein the secondary charge extends radially through the power charge from a central position.

8. The system of claim 1, wherein the tool is an expanding tool.

9. An apparatus for use in a wellbore, comprising:

a primary charge with a first activation energy; and a secondary charge, the secondary charge including a flammable metal and a plasticized solid propellant having a second activation energy greater than the first activation energy, wherein the flammable metal is a pellet embedded in the plasticized solid propellant and combustion of the primary charge initiates combustion of the flammable metal which initiates ignition of the plasticized solid propellant.

10. The apparatus of claim 9, further comprising a power charge associated with the secondary charge.

11. The apparatus of claim 10, wherein the power charge includes a dispersed plasticized solid propellant within the power charge, wherein the dispersed plasticized solid propellant is between 5% to 95% of the power charge by weight.

12. The apparatus of claim 10, wherein the secondary charge is disposed within the power charge.

13. A method for use in a wellbore, comprising:

placing a tool in the wellbore, the tool including;

a primary charge with a first activation energy, a secondary charge comprising a plasticized solid propellant having a second activation energy greater than the first activation energy and an igniter, and the igniter associated with the secondary charge, wherein the igniter is a pellet embedded in the plasticized solid propellant; and stimulating the primary charge to combust, wherein combustion of the primary charge initiates combustion of the igniter which initiates combustion of the solid propellant.

14. The method of claim 13, further comprising providing a flammable metal coupled to the secondary charge.

15. The method of claim 13, further comprising providing a power charge associated with the secondary charge.

16. The method of claim 15, wherein the power charge includes a dispersed resilient plasticized solid propellant within the power charge, wherein the dispersed resilient plasticized solid propellant is between 5% to 95% of the power charge by weight.

17. The method of claim 16, further comprising dispersing the dispersed resilient plasticized solid propellant of the power charge as fibers within the power charge.

18. The method of claim 15, further comprising disposing the secondary charge within the power charge.

19. The method of claim 13, wherein the tool is an expanding tool.

* * * * *